US007285367B2

(12) United States Patent
Kawase et al.

(10) Patent No.: US 7,285,367 B2
(45) Date of Patent: Oct. 23, 2007

(54) METHOD OF MANUFACTURING A TONER

(75) Inventors: Yoshitaka Kawase, Nara (JP); Takanori Kamoto, Yamatokoriyama (JP); Satoru Ariyoshi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 277 days.

(21) Appl. No.: 11/073,013

(22) Filed: Mar. 7, 2005

(65) Prior Publication Data

US 2005/0202336 A1 Sep. 15, 2005

(30) Foreign Application Priority Data

Mar. 5, 2004 (JP) ..... 2004-063190

(51) Int. Cl.
*G03G 9/08* (2006.01)

(52) U.S. Cl. ..... 430/137.16; 430/137.11; 430/137.14; 430/137.15

(58) Field of Classification Search ..... 430/137.11, 430/137.15, 137.16, 137.14
See application file for complete search history.

(56) References Cited

U.S. PATENT DOCUMENTS

| | | | | |
|---|---|---|---|---|
| 5,308,734 | A * | 5/1994 | Sacripante et al. | 430/137.14 |
| 5,547,794 | A | 8/1996 | Demizu et al. | 430/106 |
| 5,622,802 | A | 4/1997 | Demizu et al. | 430/106 |
| 5,925,488 | A * | 7/1999 | Patel et al. | 430/137.14 |

FOREIGN PATENT DOCUMENTS

| | | |
|---|---|---|
| JP | 7-152202 | 6/1995 |
| JP | 7-168395 | 7/1995 |
| JP | 7-168396 | 7/1995 |
| JP | 7-219267 | 8/1995 |
| JP | 7-325429 | 12/1995 |
| JP | 7-325430 | 12/1995 |
| JP | 7-333890 | 12/1995 |
| JP | 7-333899 | 12/1995 |
| JP | 7-333901 | 12/1995 |
| JP | 7-333902 | 12/1995 |
| JP | 8/179555 | 7/1996 |
| JP | 8-179556 | 7/1996 |
| JP | 9-218532 A | 8/1997 |
| JP | 9-230624 | 9/1997 |
| JP | 9-311502 A | 12/1997 |
| JP | 2001-166529 | 6/2001 |
| JP | 3351505 | 9/2002 |
| JP | 2002-328487 A | 11/2002 |

* cited by examiner

*Primary Examiner*—Christopher RoDee
*Assistant Examiner*—Peter L. Vajda
(74) *Attorney, Agent, or Firm*—Nixon & Vanderhye P.C.

(57) ABSTRACT

A method of manufacturing a toner for developing static charges in an aqueous system is provided which includes preparation step for a resin kneaded product, preparation step for the aqueous dispersion of a less water-soluble alkaline earth metal salt, preparation step for synthetic resin particles, removal step for the less water-soluble alkaline earth metal salt, and separation-cleaning-drying step. At preparation step S3 for synthetic resin, an ionic material for decomposing the less water-soluble alkaline earth metal salt is admixed with a mixture of the resin kneaded product and the aqueous dispersion of the less water-soluble alkaline earth metal salt.

13 Claims, 2 Drawing Sheets

METHOD OF MANUFACTURING A TONER

BACKGROUND OF THE INVENTION

1. Field of the Invention

The present invention relates to a method of manufacturing a toner.

2. Description of the Related Art

Along with remarkable development of office automation equipment in resent years, printers, facsimiles, copying machines that conduct printing by an electrophotographic method have been popularized. In electrophotographic methods, images are formed generally by utilizing photoconductive materials that form static images on the surface of a light sensitive body by various means, developing the static images with a toner and fixing the toner images on a transfer material such as paper.

The method of manufacturing toners for developing static images (hereinafter referred to as "static image developing toner") have been generally classified so far into a dry method and a wet method. The dry method includes, for example, a pulverization method of kneading a binder resin, a colorant, etc., and pulverizing and classifying them. On the other hand, the wet method includes, for example, (i) a suspension polymerization method of polymerizing a monomer of a binder resin dispersed in an organic solvent by an organic suspension stabilizer under the presence of a colorant and incorporating the colorant in the resultant binder resin particles to obtain a toner, (ii) a coagulation method by emulsion polymerization of mixing a liquid resin dispersion and a liquid colorant dispersion formed by dispersing a colorant into an organic solvent to form coagulated particles and heating to fuse the coagulated particles to obtain a toner, (iii) a phase transition emulsion method of dissolving or dispersing a water dispersible resin and a colorant into an organic solvent, adding thereto a neutralizing agent that neutralizes dissociation groups of the water-soluble resin and water under stirring to form resin droplets incorporating the colorant, etc., and subjecting them to phase transition emulsification to obtain a toner, (iv) a method of dissolving or dispersing a binder resin and a colorant into an organic solvent to which the binder resin is soluble, mixing them with an aqueous dispersion of a less water-soluble alkaline earth metal salt such as calcium phosphate or calcium carbonate, conducting pelleting and removing the organic solvent to obtain a toner (for example, refer to Japanese Unexamined Patent Publication JP-A 7-152202 (1995), 7-168395 (1995), 7-168396 (1995), 7-219267 (1995), 8-179555 (1996), 8-179556 (1996), and 9-230624 (1997)), (v) an emulsifying dispersion method of dissolving or dispersing a binder resin and a colorant in a water insoluble organic solvent, dispersing under emulsification the solution or the liquid dispersion into an aqueous dispersion and then removing the organic solvent to obtain a toner (for example, refer to Japanese Unexamined Patent Publication JP-A 7-325429 (1995), 7-325430 (1995), 7-333890 (1995), 7-333899 (1995), 7-333901 (1995), and 7-333902 (1995)). Further, (f) a method of mixing a molten material of a resin having a ionic group and a colorant, and an aqueous medium containing a material that neutralizes the ionic groups under heating and pressure to obtain a toner is also known (for example, refer to the specification of Japanese examined Patent Publication JP-B 3351505).

Toners obtained by the dry method have particle size distribution of a relatively wide range and tend to vary in the charging performance. Formation of images by using a toner with such varied charging performance is not preferred since this generates color shading or the like in the images. On the contrary, since a toner with small grain size distribution and less variation of the charging performance can be produced relatively easily by the wet method, the wet method is often adopted in the manufacture of the toner. However, the wet method also involves a problem to be solved.

For example, an organic solvent for dissolving or dispersing the binder resin, a monomer for the binder resin, etc., sometimes remains slightly in the obtained toner particles to vary the charging performance of the toner particles. Further, the shape of the toner particles becomes uneven to vary the charging performance depending on the pressure (depressurization), temperature, time, etc. upon removing the organic solvent for solving or dispersing the binder resin.

Further, in the suspension polymerization method mentioned the above (i), the organic suspension stabilizer remains on the surface of the obtained toner particles to worsen the charging performance of the toner particles. Removal of the organic suspension stabilizer requires a complicate step to increase the manufacturing cost of the toner.

Further, the method mentioned the above (vi) involves a problem in that the formed toner particles are adhered to each other to cause growing. For preventing this, while it is necessary to precisely control various conditions such as a liquid temperature in the mixing system after mixing, such control is actually difficult extremely.

Further, since the organic solvent, the monomer for the binder resin, etc. generally used in the wet method give large burden on the environment, it requires a disposal equipment to increase the manufacturing cost.

On the other hand, the toner obtained by the existent methods as described above do not provide the picture quality of images by using the same (image density, absence or presence of white background fogging, etc.) formed on a transfer material and characteristics such as a transfer ratio to the transfer material together at high level.

SUMMERY OF THE INVENTION

It is an object of the invention to provide a toner manufacturing method for manufacturing a toner having uniform shape and size of particles and excellent in various characteristic as an electrostatic developing toner, with no growth of toner particles caused by their adherence to each other, and no residue of ingredients in toner particles that give undesired effects on the charging performance of the toner and not requiring complicate operation such as removal of the organic suspension stabilizer.

The invention provides a method of manufacturing a toner comprising:

a step (A) of forming synthetic resin particles containing a colorant, whose surfaces are covered with a less water-soluble alkaline earth metal salt by mixing a resin kneaded product at least containing the synthetic resin and the colorant and not containing an organic solvent and an aqueous dispersion of the less water-soluble alkaline earth metal salt under heating or under heating and pressurization and cooling them; and a step (B) of removing the less water-soluble alkaline earth metal salt from the surface of the synthetic resin particles containing the colorant, wherein an ionic material that decomposes the less water-soluble alkaline earth metal salt is added to the mixture of the resin kneaded product and the aqueous dispersion of the less water-soluble alkaline earth metal salt in the step (A).

Further, in the invention, it is preferable that addition of the ionic material in the step (A) described above is conducted at the same time with the mixing of the resin kneaded product and the aqueous dispersion of the less water-soluble alkaline earth metal salt, or after mixing of them and before the cooling of the mixture.

Further, in the invention, it is preferable that removal of the less water-soluble alkaline earth metal salt in the step (B) described above is conducted by the addition of the ionic material that decomposes the less water-soluble alkaline earth metal salt.

Further, in the invention, it is preferable that the ionic material is an inorganic acid and/or an organic acid.

Further, in the invention, it is preferable that the ionic material is used in the form of an aqueous solution.

Further, in the invention, it is preferable that the addition amount of the ionic material in the step (A) described above is from 10% by weight to 50% by weight (10% by weight or more and 50% by weight or less) based on an amount of the ionic material that completely decomposes the less water-soluble alkaline earth metal salt in the aqueous dispersion.

Further, in the invention, it is preferable that the less water-soluble alkaline earth metal salt is a calcium carbonate salt.

According to the invention, there is provided a method of manufacturing a toner comprising a step (A) of forming synthetic resin particles containing a colorant, whose surfaces are covered with a less water-soluble alkaline earth metal salt, and a step (B) of removing the less water-soluble alkaline earth metal salt from the surfaces of the synthetic resin particles containing the colorant.

In the step (A) of the invention, the resin kneaded product and the aqueous dispersion of the less water-soluble alkaline earth metal salt are at first mixed under heating, by which the resin kneaded product is finely pulverized and pelleted to form synthetic resin particles containing the colorant (hereinafter simply referred to as "synthetic resin particles" unless otherwise specified). Since the synthetic resin particles just after the formation are in a molten state and tacky, synthetic resin particles usually adhere to each other and grow. However, since the fine pulverization of the resin kneaded product is conducted under the presence of the less water-soluble alkaline earth metal salt and the less water-soluble alkaline earth metal salt is deposited densely and uniformly on the surface of the formed synthetic resin particles, growth of the synthetic resin particles is prevented to obtain a mixture containing synthetic resin particles of uniform shape and size. According to the study made by the present inventor it has been found that deposition of the less water-soluble alkaline earth metal salt on the surface of the synthetic resin particles in the molten state causes concaved portions, crackings, etc. to the surface of the synthetic resin particles to deteriorate the surface smoothness and vary the charging performance thereof, causing lowering of the transfer ratio to the transfer material and image density (optical density) and occurrence of white background fogging upon image formation. In the invention, it has been found that toner particles of excellent surface smoothness can be manufactured by the addition of the ionic material that decomposes the less water-soluble alkaline earth metal salt (hereinafter referred to simply as "ionic material" unless otherwise specified) to a mixture containing the synthetic resin particles thereby preventing occurrence of concaved portion, crackings, etc. due to the deposition of the less water-soluble alkaline earth metal salt.

Accordingly, the manufacturing method of the invention has the following advantages.

(1) A toner particle obtained by the manufacturing method of the invention has a volume average particle size of about 3 to 15 μm, a narrow range for the grain size distribution, and has a uniform shape and size of the particle, with extremely less occurrence of concaved portion, crackings, etc., an excellent surface smoothness, with no variation of charging property and it can be used suitably, for example, as a toner for developing static charged images such as in the electrophotographic system. Then, when the toner particles are used in the electrophotographic system, since they are transferred at a high ratio to the transfer material, images of high picture quality at high image density (optical density) and with no white background fogging can be formed easily.

(2) In the invention, since the less water-soluble alkaline earth metal salt can be easily decomposed and removed by the addition of the ionic material and the decomposition product of the less water-soluble alkaline earth metal salt and the remaining ionic material can also be removed easily by water cleaning or the like, a complicate step such as removal of the organic suspension stabilizer in the existent wet method is not necessary, which can simplify the step and is industrially advantageous.

(3) Any synthetic resins can be used so long as they can be melted by heating. Even a synthetic resin of low solubility to organic solvent which was difficult to be used in the existent wet method can be used with no trouble so long as it can be melted by heating. Accordingly, the range of the usable synthetic resins is extended than that in the existent wet method, plural different synthetic resins can also be used in combination and the low temperature fixing property, durability, etc. of the obtained toner particles can be controlled with ease.

(4) Since the monomer for the synthetic resin and the organic solvent are not used, they do not remain in the toner particles and the shape of the toner particles does not become ununiform by the treatment such as classification and drying. Further, developing rollers and other members for use in the image forming apparatus are scarcely damaged. Further, a facility for disposing the organic solvent, etc. is not required and the toner can be manufactured efficiently and at a reduced cost. Burden on the environment is extremely small as well.

Further, according to the invention, since the timing for adding the ionic material in the step (A) is set simultaneously with the mixing of the resin kneaded product and the aqueous dispersion of the less water-soluble alkaline earth metal salt, or during the period after mixing till the cooling of the mixture. The effect of successively decomposing the less water-soluble alkaline earth metal salt deposited on the surface of the synthetic resin particles in the molten state occurs repeatedly while providing the function of preventing the adherance between the synthetic resin particles to each other and, finally, the synthetic resin particles are cooled and loss the tackiness. Accordingly, occurrence of concaved portions, crackings, etc. on the surface of the synthetic resin particles can be further reduced, as well as toner particles having high surface smoothness and further uniformity in the shape and the size can be obtained.

Further, according to the invention, since the removal of the less water-soluble alkaline earth metal salt in the step (B) is conducted by the addition of the ionic material, the step for the manufacturing method of the invention can be further simplified and made industrially advantageous.

Further, according to the invention, inorganic acids and organic acids are preferred as the ionic material. The acids described above can efficiently decompose the less water-soluble alkaline earth metal salt with such a small amount that the charging performance of the formed toner particles is not adversely affected. In addition, the inorganic acid, the organic acid and the decomposition products of the less water-soluble alkaline earth metal salt formed by the acids can be removed easily by water cleaning or the like.

Further, according to the invention, the inorganic acid as the ionic material is used in the form of the aqueous solution and thereby, the addition amount can be controlled easily, so that the inorganic acid can be added in a necessary amount to obtain an optimal surface state depending on whether the surface of the synthetic resin particles is in a molten state, a semi-molten state where the tackiness is present sufficiently or in a semi-solidified state where the tackiness is being lost.

Further, according to the invention, in a case where the total addition amount of the ionic material is controlled as from 10 to 50% by weight for the mass of the ionic material necessary for completely decomposing the less water-soluble alkaline earth metal salt in the aqueous dispersion, growth caused by the adherence of the synthetic resin particles to each other, and occurrence of concaved portions, crackings, etc. on the surface of the synthetic resin particles can be prevented efficiently.

Further, according to the invention, toner particles particularly excellent in the surface smoothness, with extremely less concavance, cracking, etc., on the surface, having a uniform shape and size, and with further reduced variation of the charging performances can be obtained by using the calcium carbonate as the less water-soluble alkaline earth metal salt.

BRIEF DESCRIPTION OF THE DRAWINGS

Other and further objects, features, and advantages of the invention will be more explicit from the following detailed description taken with reference to the drawing wherein.

DETAILED DESCRIPTION OF THE PREFERRED EMBODIMENTS

Figure 1:
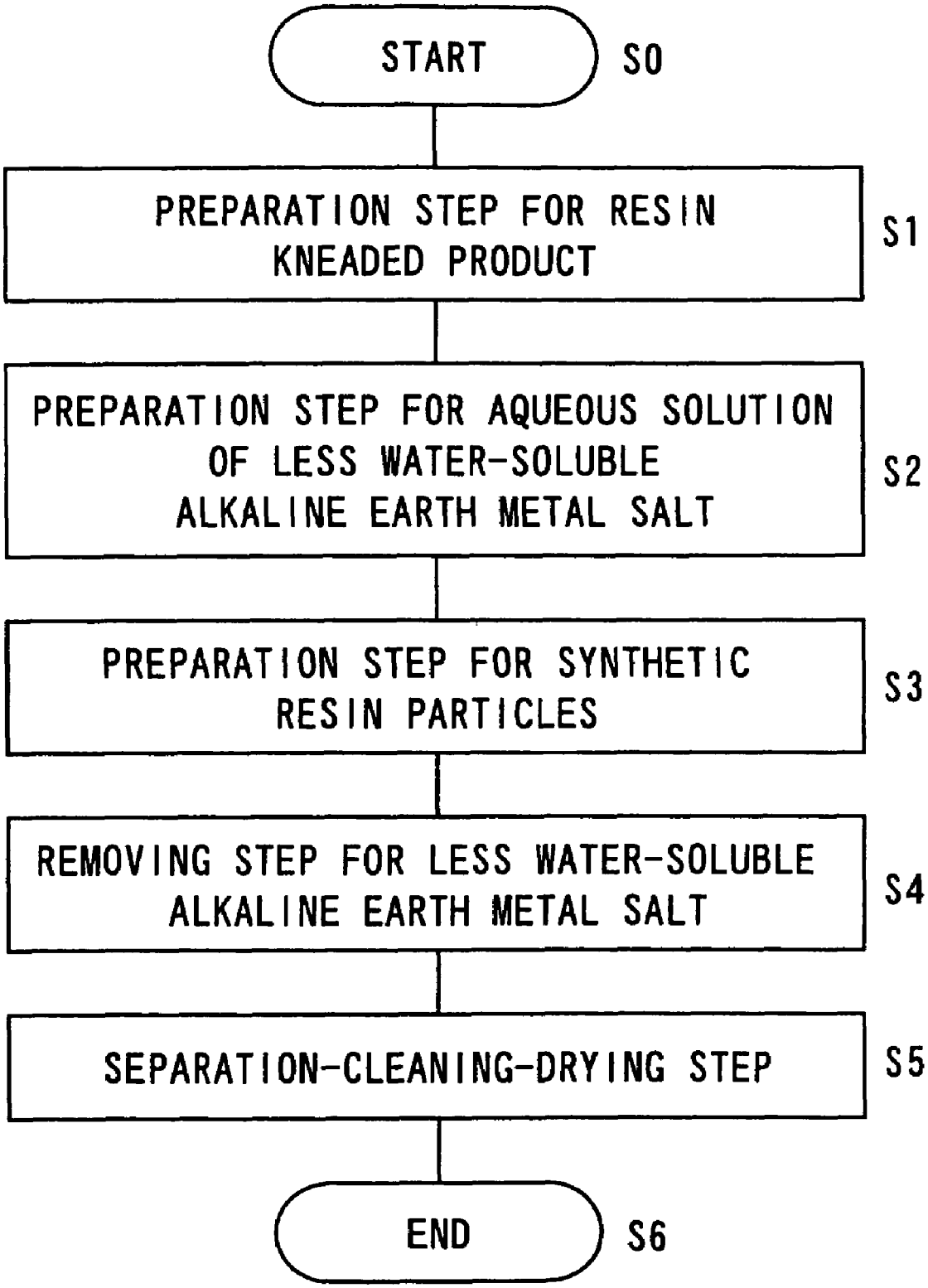
FIG. 1 is a flow chart showing an embodiment of a method of manufacturing a toner according to the invention.

Now referring to the drawings, preferred embodiments of the invention are described below.

A method of manufacturing a toner according to the invention comprises a step (A) of forming synthetic resin particles containing a colorant, whose surfaces are covered with a less water-soluble alkaline earth metal salt by mixing a resin kneaded product containing the synthetic resin and the colorant and not containing an organic solvent and an aqueous dispersion of the less water-soluble alkaline earth metal salt under heating or under heating and pressurization, adding an ionic material to the mixture, and cooling them, and a step (B) of removing the less water-soluble alkaline earth metal salt from the surface of the synthetic resin particles obtained in the step (A).

FIG. 1 is a flow chart showing an embodiment of the method of manufacturing a toner according to the invention.

The method of manufacturing a toner of the invention comprises preparation step S1 for the resin kneaded product, preparation step S2 for the aqueous dispersion of the less water-soluble alkaline earth metal salt, preparation step S3 for the synthetic resin particles, removing step S4 for the less water-soluble alkaline earth metal salt, and separation-cleaning-drying step S5. Among the steps, preparation step S1 for the resin kneaded product, preparation step S2 for the aqueous dispersion of the less water-soluble alkaline earth metal salt, and preparation step S3 for the synthetic resin particles are included in the step (A), while removing step S4 for the less water-soluble alkaline earth metal salt and separation-cleaning-drying step S5 are included in the step (B). Either preparation step S1 for the resin kneaded product or preparation step S2 for the aqueous dispersion of the less water-soluble alkaline earth metal salt may be conducted previously. The method of manufacturing a toner of the invention starts a sequence of steps from step S0.

Preparation step S1 for resin kneaded product is a step of melt-kneading the synthetic resin and the colorant to prepare the resin kneaded product.

The synthetic resin is used as a binder resin for toner particles. The synthetic resin is not particularly restricted so long as it can be melted by heating and known resins can be used and includes, for example, polyester, polyurethane, epoxy resin and acryl resin.

The polyester is synthesized by usual polycondensation reaction. For example, the polyester can be obtained by dehydrogenating condensation reaction of a polybasic acid and a polyhydric alcohol under the presence or absence of an organic solvent and under the presence of a catalyst. In this case, a methyl etherification product of a polybasic acid may be used to a portion of the polybasic acid and de-methanol polycondensation reaction may be conducted. As the polybasic acid, those used customarily as monomers for polyesters can be used and include, for example, aromatic carboxylic acids such as terephthalic acid, isophthalic acid, phthalic acid anhydride, trimellitic acid anhydride, pyromellitic acid, and naphthalene dicarboxylic acid, and aliphatic carboxylic acids such as maleic acid anhydride, fumalic acid, succinic acid, alkenyl succinic acid anhydride, and adipic acid. The polybasic acid can be used alone or two or more of the acids can be used together. As the polyhydric alcohol, those used customarily as monomers for polyesters can be used and include, for example, aliphatic polyhydric alcohols such as ethylene glycol, propylene glycol, butane diol, hexane diol, neopentyl glycol, and glycerin, alicyclic polyhydric alcohols such as cyclohexane diol, cyclohexane dimethanol and hydrogenated bisphenol A, and aromatic diols such as ethylene oxide adduct of bisphenol A, and propylene oxide adduct of bisphenol A. The polyhydric alcohol may be used alone or two or more of the alcohols can be used together. The polycondensation reaction of the polybasic acid and the polyhydric alcohol may be terminated at the instance the acid value and the softening point of the resultant resin show predetermined values. In this case, by properly changing the blending ratio and the reaction rate of the polybasic acid and the polyhydric alcohol, the content of the terminal carboxylic groups of the polyester can be controlled and, thus, the characteristics of the obtained polyester (for example, softening point) can be controlled. Further, in a case of using trimellitic acid anhydride as the polybasic acid, carboxyl groups can be introduced easily into the main chain of the polyester and thereby, the obtained polyester can also be modified.

The polyurethane is not particularly restricted and, for example, acidic group- or basic group-containing polyurethanes can be used preferably. The acidic group- or basic group-containing polyurethane can be produced in accordance with the known method. For example, an acidic group- or a basic group-containing diol, a polyol and a polyisocyanate may be subjected to addition polymerization. The acidic group- or basic group-containing diol includes, for example, dimethylol propionic acid and N-methyl diethanolamine. The polyol includes, for example, polyether polyol such as polyethylene glycol, polyester polyol, acryl polyol, and polybutadiene polyol. The polyisocyanate includes, for example, tolylene diisocyanate, hexamethylene diisocyanate, and isophorone diisocyanate. Each of the ingredients can be used alone or two or more of the ingredients may be used together.

The epoxy resin is not particularly restricted and, for example, an acidic group- or basic group-containing epoxy resin can be used preferably. The acid group- or basic group-containing epoxy resin can be produced, for example, by addition or addition polymerization of a polybasic carboxylic acid such as adipic acid or trimellitic acid anhydride or an amine such as dibutyl amine, ethylene diamine to an epoxy resin as a base.

Also the acryl resin is not particularly restricted, and a acid group-containing acrylic resin can be used preferably. The acidic group-containing acrylic resin can be produced, for example, by polymerizing an acrylic resin monomer and a vinyl monomer, while using an acrylic resin monomer containing an acidic group or a hydrophilic group and/or a vinyl monomer containing an acidic group or a hydrophilic group together. Known acrylic resin monomers can be used and include, for example, (meth)acrylic acid which may have a substituent and a (meth)acrylic acid ester which may have a substituent. The acrylic resin monomer can be used alone or two or more of the monomers can be used together. Also for the vinylic monomer, known monomers can be used and include, for example, styrene, α-methylstyrene, vinyl bromide, vinyl chloride, vinyl acetate and (meth)acrylonitrile. The vinyl monomer can be used alone or two or more of the monomers can be used together. Polymerization is conducted by solution polymerization, suspension polymerization, emulsification polymerization, etc using a usual radial initiator.

Among the synthetic resins described above, polyesters are preferred. Since the polyesters are excellent in the transparency and can provide the obtained toner particles with good powder flowability, low temperature fixing property and secondary color reproducibility, they are suitable as the binder resin for the color toner. Further, a polyester and an acrylic resin may also be used by grafting.

Further, in view of easy conduction of the pelting operation, kneading property with the colorant and making the shape and the size of the toner particles more uniform, synthetic resins having melting point of 150° C. or lower are preferred and synthetic resins having melting point of from 60 to 150° C. are particularly preferred. Among them, synthetic resins having a weight average molecular weight from 5000 to 500,000 are preferred.

The synthetic resins can be used each alone or two or more of the resins can be used together. Further, with respect to identical type of resins, those which are different in any one or all of molecular weight, monomer composition, etc. may be used in a plurality of species.

As the colorant to be mixed with the synthetic resin, known organic dyes, organic pigments, inorganic dyes and inorganic pigments can be used. Specific examples of the colorant are shown on every color as follows.

A black colorant includes, for example, carbon black, copper oxide, manganese dioxide, aniline black, activated carbon, non-magnetic ferrite, magnetic ferrite, and magnetite.

Yellow colorant includes, for example, yellow lead, zinc yellow, cadmium yellow, yellow iron oxide, mineral fast yellow, nickel titanium yellow, navel yellow, naphtol yellow-S, hanza yellow-G, hanza-yellow 10G, benzidine yellow-G, benzidine yellow-GR, quinoline yellow lake, permanent yellow-NCG, tartrazine lake, C.I. pigment yellow 12, C.I. pigment yellow 13, C.I. pigment yellow 14, C.I. pigment yellow 15, C.I. pigment yellow 17, C.I. pigment yellow 93, C.I. pigment yellow 94, and C.I. pigment yellow 138.

Orange colorant includes, for example, red lead yellow, molybdenum orange, permanent orange GTR, pyrazolone orange, vulcan orange, indanthrene brilliant orange RK, benzidine orange G, indanthrene brilliant orange GK, C.I. pigment orange 31, and C.I. pigment orange 43.

Red colorant include, for example, red iron oxide, cadmium red, red lead oxide, mercury sulfide, cadmium, permanent red 4R, lysol red, pyrazolone red, watching red, calcium salt, lake red C, lake red D, brilliant carmine 6B, eosin lake, rhodamine lake B, alizarin lake, brilliant carmine 3B, C.I. pigment red 2, C.I. pigment red 3, C.I. pigment red 5, C.I. pigment red 6, C.I. pigment red 7, C.I. pigment red 15, C.I. pigment red 16, C.I. pigment red 48:1, C.I. pigment red 53:1, C.I. pigment red 57:1, C.I. pigment red 122, C.I. pigment red 123, C.I. pigment red 139, C.I. pigment red 144, C.I. pigment red 149, C.I. pigment red 166, C.I. pigment red 177, C.I. pigment red 178, and C.I. pigment red 222.

Purple colorant includes, for example, manganese purple, fast violet B, and methyl violet lake.

Blue colorant includes, for example, Prussian blue, cobalt blue, alkali blue lake, Victoria blue lake, phthalocyanine blue, non-metal phthalocyanine blue, phthalocyanine blue-partial chlorination product, fast sky blue, indanthrene blue BC, C.I. pigment blue 15, C.I. pigment blue 15:2, C.I. pigment blue 15:3, C.I. pigment blue 16, C.I. pigment blue 60.

Green colorant includes, for example, chromium green, chromium oxide, pigment green B, malachite green lake, final yellow green G, C.I. pigment green 7.

White colorant includes, for example, those compound such as zinc white, titanium oxide, antimony white, and zinc sulfide.

The colorants can be used each alone or two or more of the colorants of different colors can be used together. Further, two or more of the colorants with an identical color can be used together.

A ratio of using the synthetic resin and the colorant is not particularly restricted and it is usually from 0.1 to 20 parts by weight and, preferably, from 0.2 to 10 parts by weight based on 100 parts by weight of the synthetic resin.

The resin kneaded product can optionally contains wax in addition to the synthetic resin and the colorant. Those waxes used customarily in this field can be used and include, for example, natural wax such as carnauba wax and rice wax, synthesis wax such as polypropylene wax, polyethylene wax, and Fischer Tropsch, coal type wax such as montan wax, alcohol type wax and ester type wax. The waxes can be used each alone or two or more of the waxes may be used together.

Further, the resin kneaded product may also include optionally, for example, general resin additives such as charge controller, in addition to the synthetic resin and the colorant.

The resin kneaded product can be produced, for example, by dry mixing a synthetic resin, a colorant and, optionally, various additives described above in a mixer, then melt-kneading them while heating at a temperature higher than the melting temperature of the synthetic resin (usually about 80 to 200° C., preferably, about 100 to 150° C.). Known mixers can be used including, for example, Henschel type mixing apparatus such as a Henschel mixer (trade name of products manufactured by Mitsui Mining Co.), a super mixer (trade name of products, manufactured by Kawata Co.), a MECHANO mill (trade name of products, manufactured by Okada Seiko Co.), ONGU mill (trade name of products, Hosokawa Micron Co.), Hybridization system (trade name of products, manufactured by Nara Kikai Seisakusho Co.), and Cosmo system (trade name of products, manufactured by Kawasaki Heavy Industry Co.). For melt kneading, general kneading machines such as a twin-screw extruder, three rolls, and laboplast mill can be used and, more specifically, the kneading machines include, for example, single or twine screw extruders such as TEM-100B (trade name of products, manufactured by Toshiba Kikai Co.), PCM-65/87 (trade name of products, manufactured by Ikegai Co.), and open roll systems such as Kneadics (trade name of products, manufactured by Mitsui Mining Co.).

Preparation step S2 for the aqueous dispersion of the less water-soluble alkaline earth metal salt is a step of dispersing the less water-soluble alkaline earth metal salt into water thereby preparing an aqueous dispersion of the less water-soluble alkaline earth metal salt.

The less water-soluble alkaline earth metal salt used in the invention is scarcely water-soluble (solubility to 1 liter of water at 20° C., preferably, 50 mg or less and, more preferably, 30 mg or less), has water dispersibility and is decomposed by an ionic material. Since a highly water-soluble material is present in a state dissolved in water and does not adhere to the surface of the synthetic resin particles, it can not prevent the synthetic resin particles from adhering to each other to cause growing. Further, even when the material is less water-soluble, in a case where a material not decomposed by an ionic material such as an acid or alkali is used, it requires additional and complicate steps for removing the material adhered to the surface of the synthetic resin particles.

As the less water-soluble alkaline earth metal salt, known materials can be used and, among all, calcium carbonate salt, calcium phosphate salt, etc. are preferred and the calcium salt is particularly preferred.

Three poly species, i.e., calcite (water-solubility: 14 mg/liter, at 20° C.), aragonite (water-solubility: 15 mg/liter, at 20° C.), and vaterite (water-solubility: 24 mg/liter, at 20° C.), are present in the calcium carbonate salt and all of them show less water-solubility. Further, the calcium carbonate salt is reacted, in an aqueous system, with an acid by controlling the pH of the aqueous system to an acidic region, preferably, from 1 to 3 with a inorganic acid such as hydrochloric acid, sulfuric acid or nitric acid and is decomposed into calcium ion, water and carbon dioxide ($CaCO_3+2HCl \rightarrow Ca^2+2Cl^-+H_2O+CO_2\uparrow$). Among them, calcium ions are dissolved in water and carbon dioxide, being a gas, is discharged spontaneously out of the system. Accordingly, calcium carbonate can be removed easily from the surface of the resin particles by the addition of the acid. Further, since the starting temperature for the heat decomposition of calcium carbonate is about 850° C., it is stable even when exposed to a melting temperature of general synthetic resins (usually about from 100 to 300° C.). Calcium carbonate includes heavy calcium carbonate, light calcium carbonate and colloidal calcium carbonate mainly depending on the difference of the manufacturing method and, among them, colloidal calcium carbonate excellent in water dispersibility is preferred.

The calcium phosphate includes, for example, calcium tertiary phosphate, hydroxy apatite, etc. The calcium phosphate also has a property of being decomposed by an ionic material such as an inorganic acid.

The less water-soluble alkaline earth metal salts can be used each alone or two or more of them can be used together.

The less water-soluble alkaline earth metal salt is present in an aqueous dispersion thereof in the form of secondary particles where primary particles are agglomerated. In the invention, a less water-soluble alkaline earth metal salt with an average dispersion diameter of the second particles of 1 μm or less is preferred. This is because the surface of the synthetic resin particles can not be sometimes coated uniformly in a case where the particle size is much more than 1 μm to result in a case not capable of preventing the synthetic resin particles from adhering to each other.

While the amount of the less water-soluble alkaline earth metal salt to be used is not particularily restricted, it is preferred from 10 to 500 parts by weight based on 100 parts by weight of the resin kneaded product. In a case where the amount of use is much less than 10 parts by weight, no sufficient dispersibility and stability thereof can be obtained and, in addition, there may be a worry that the addition effect can not be provided sufficiently. On the other hand, in a case where the amount of use is much more than 500 parts by weight, viscosity of the aqueous dispersion increases and the dispersive dispersion thereof in water tends to become unstable, so that there is a possibility that the salt does not uniformly deposit on the surface of the synthetic resin particles.

The content of the less water-soluble alkaline earth metal salt in the aqueous dispersion is not particularly restricted and may be properly selected within a wide range from such an amount as capable of smoothly conducting the mixing operation for the resin kneaded product and the aqueous dispersion efficiently and smoothly while considering the amount of the less water-soluble alkaline earth metal salt to be used based on the resin kneaded product and it is, preferably, from 0.1 to 20% by weight based on the entire amount of the aqueous dispersion.

The aqueous dispersion containing the less water-soluble alkaline earth metal salt can contain a surfactant, a water-soluble polymeric compound, etc. as a dispersion stabilizer. The dispersion stabilizer prevents agglomeration of the calcium carbonate salt in water to improve the dispersibility. Since it is present in the form near the primary particles in water, the water dispersibility is favorable and the dispersibility is not lowered even when the concentration increases, and the concentration can be controlled easily. As a result, the dispersibility of the calcium carbonate salt on the surface of the synthetic resin particles is improved and the grain size distribution of the obtained toner particles is narrower compared with a case of not using the dispersion stabilizer. The surfactant includes, for example, sodium dodecyl benzene sulfate, sodium tetradecyl sulfate, sodium pentadecyl sulfate, sodium octyl sulfate, sodium dodecyl benzene sulfonate, sodium oleate, sodium laurate, sodium stearate, and potassium stearate. The surfactants may be used each alone or two or more of the surfactants can be used together. The water-soluble polymeric compound includes, for example, water-soluble polymeric compounds such as polyvinyl alcohol, polyvinyl pyrrolidone, hydroxyethyl cellulose, carboxymethyl cellulose, cellulose gum, polyacrylic acid, and polycarboxylic acid, as well as metal salts or ammonium salts thereof. The water-soluble polymeric compounds can be used each alone or two or more of the compounds can be used together. The addition amount of the dispersion stabilizer is, preferably, from 0.001 to 0.1 parts by weight based on 100 parts by weight of the synthetic resin contained in the resin kneaded product. In a case where it is less than 0.001 parts by weight, the addition effect of the surfactant can not possibly be developed sufficiently. On the other hand, with much more than 0.1 parts by weight, the surface state of the toner particles obtained finally is worsened to possibly give undesired effects on the dispersibility of the less water-soluble alkaline earth metal salt on the surface of the resin particles.

Preparation step S3 for the synthetic resin particles is a step of mixing a resin kneaded product and an aqueous dispersion of a less water-soluble alkaline earth metal salt and forming synthetic resin particles with the less water-soluble alkaline earth metal salt being adhered on the surface thereof.

Mixing of the resin kneaded product and the aqueous solution of the less water-soluble alkaline earth metal salt is conducted under heating or under pressurization and heating. The mixing is preferably conducted under shearing. For the resin kneaded product, synthetic resin, colorant, etc. which are melted and kneaded may be used as they are, or solidification products after the melt kneading or the solidification products formed into the molten state again by heating may also be used. While the heating temperature can be property selected within a wide range depending on the synthetic resin contained in the resin kneaded product and characteristics thereof (for example, molecular weight, softening point, etc.), and the grain size of the toner particles to be obtained finally and, preferably, it is within a range from the softening point of the synthetic resin contained in the resin kneaded product to the decomposition temperature of the synthesis resin. In a case where the heating temperature exceeds 100° C., the mixing operation is conducted under pressure. Also the value of the pressure is not particularly restricted and may be selected properly within a wide range depending on the synthesis resin contained in the resin kneaded product, easiness for the conduction of the mixing operation, grain size of the toner particles to be obtained, etc. Further, the value for the shearing force is not particularly limited and the value may be properly selected depending on the synthesis resin contained in the resin kneaded product, so that by which the mixing operation can be practiced easily and synthesis resin particles of a desired grain size, grain size distribution and shape can be obtained.

The mixing ratio of the resin kneaded product and the aqueous dispersion of the less water-soluble alkaline earth metal salt is not particularly restricted, and the aqueous dispersion is preferably used by from 100 to 5000 parts by weight based on 100 parts by weight of the resin kneaded product while considering the amount of the less water-soluble alkaline earth metal salt to be used relative to the amount of the synthetic resin in the resin kneaded product and the content of the less water-soluble alkaline earth metal salt in the aqueous dispersion, and also considering the efficient conduction of the mixing operation, the succeeding decomposing operation of the less water-soluble alkaline earth metal salt, cleaning operation, the isolation operation of the toner particles, etc.

The kneading product and the aqueous dispersion of the less water-soluble alkaline earth metal salt are mixed, for example, by using an emulsifying apparatus, or dispersing apparatus.

Preferred emulsifying apparatus and the dispersing apparatus are those capable of receiving the resin kneaded product and the aqueous dispersion of the less water-soluble alkaline earth metal salt batchwise or continuously, having heating means or heating and pressurizing means, and capable of mixing the resin kneaded product and the liquid dispersion under heating or under heating and pressurization, forming synthetic resin particles containing the colorant and discharging the synthetic resin particles batchwise or continuously. Further, the emulsifying apparatus and the dispersing apparatus are preferably those having stirring means and capable of mixing the resin kneaded product and the aqueous dispersion of the less water-soluble alkaline earth metal salt under stirring. Further, the emulsifying apparatus and the dispersing apparatus are preferably those in which a stirring vessel for mixing the resin kneaded product and the aqueous dispersion of the less water-soluble alkaline earth metal salt has a temperature control means. The stirring vessel is preferably pressure resistant and, further preferably, is pressure resistant and also provided with a pressure control valve, etc. By the use of the stirring vessel described above, the temperature in the vessel can be maintained substantially constant and the pressure is also controlled to a constant pressure due to the balance between the melting temperature of the synthetic resin and the vapor pressure of the aqueous dispersion. Further, in a case where it is used at 100° C. or higher, since it is used under a pressurized state, the emulsifying apparatus and the dispersing apparatus are desirably those having mechanical seals or provided with a stirring vessel capable of being tightly closed.

Such emulsifying apparatus and dispersing apparatus are commercially available. Specific examples include, for example, batch type emulsifying apparatus such as Ultra Tarax (trade name of products, manufactured by IKA Japan Co.,) Polytron homogenizer (trade name of products, manufactured by Kinematica Co.), TK Auto Homomixer (trade name of products, manufactured by Tokushu Kika Kogyo Co.), continuous type emulsifying apparatus such as Ebara Milder (trade name of products, manufactured by Ebara Seisakusho Co.), TK pipeline homomixer, TK homomix line flow, and Filmix (each trade name of products, manufactured by Tokushu Kika Kogyo Co.), Colloid mill (trade name of products, manufactured by Shinko Pantec Co.), Slusher, and Trigonal wet pulverizer (each trade name of products, manufactured by Mitui Miike Kakoki Co.), Cavitron (trade name of products, manufactured by Eurotec Co.), Fine Flow Mill (manufactured by Taiheiyo Kiko Co.), and Clear mix (trade name of products, manufactured by M Technique Co), and Filmix (trade name of products, manufactured by Tokushu Kika Kogyo Co.).

In the mixing of the resin kneaded product and the aqueous dispersion of the less water-soluble alkaline earth metal salt under heating, the mixing time is not particularly restricted and can be selected properly within a wide range depending on various conditions such as the type and the amount of use of the synthetic resin in the resin kneaded product, the type and the content of the less water-soluble alkaline earth metal salt in the aqueous dispersion, heating temperature, etc.

After the mixing, the mixture of the resin kneaded product and the aqueous dispersion is cooled and the synthetic resin particles present in the mixture are solidified. Cooling is preferably conducted by spontaneous cooling.

At step S3, an ionic material that decomposes the less water-soluble alkaline earth metal salt is added to the mixture of the resin kneaded product and the aqueous dispersion of the less water-soluble alkaline earth metal salt.

The ionic material is not particularly restricted so long as it has water-solubility and decomposes the less water-soluble alkaline earth metal salt by dissociation in water and known materials can be used. For example, they include acids, alkalis, etc. As the acids, known acids can be used including, for example, inorganic acids such as hydrochloric acid, sulfuric acid, nitric acid and carbonic acid, and organic acids such formic acid and acetic acid. As the alkalis, known alkalis can be used including, for example, ammonia, and alkali metal hydroxides such as sodium hydroxide and potassium hydroxide. Among them, acids are preferred, inorganic acids are more preferred and, hydrochloric acid, sulfuric acid, etc. are particularly preferred.

While the ionic material can be used in any of the state of gas, liquid or solid, and the liquid form is preferred and a form of aqueous solution is particularly preferred in view of the solubility into the mixture and easy control of the addition amount. In a case of use in the aqueous solution, the concentration of the ionic material is not particularly restricted and can be selected properly within a wide range depending, for example, on the ionic material, the content of the less water-soluble alkaline earth metal salt in the aqueous dispersion, etc. and it is, preferably, from 10 to 50% by weight.

The ionic material is added at the timing, preferably, simultaneously with the mixing of the resin kneaded product and the aqueous dispersion or during the period from just after the mixing till the solidification of the synthetic particles by cooling to lose the depositability and, more preferably, during the period from just after the mixing till the solidification of the synthetic resin particles by cooling to lose tackiness. Particularly preferably, this is during the period after the stopping of heating till the liquid temperature of the mixture containing the synthetic resin particles lowers, preferably, to 50° C. or lower and, more preferably, 30° C. or lower. The addition amount of the ionic material is, preferably, from 10 to 50% by weight for the amount of the ionic material that completely decomposes the less water-soluble alkaline earth metal salt contained in the aqueous dispersion. In a case where it is less than 10% by weight, the addition effect of the ionic material cannot be provided sufficiently to possibly result in synthetic resin particles having concaved portions or crackings on the surface. On the other hand, if it exceeds 50% by weight, synthetic resin particles may be adhered and agglomerated to each other to possibly form coarse particles of different shapes. The amount of the ionic material that completely decomposes the less water-soluble alkaline earth metal salt can be determined by deciding the ionic material and the less water-soluble alkaline earth metal salt and with reference to the reaction ratio based on the chemical reaction formula or by experiment.

The ionic material may be preferably added to the mixture intermittently while dividing a predetermined amount into plural fractions or may be added to the mixture continuously for a long time in accordance with the solvent removing rate. They may be conducted in combination.

As described above, it is possible to obtain a mixture containing synthetic resin particles (starting toner material) which contain the colorant on the surface of which the less water-soluble alkaline earth metal salt is deposited and concaved portions or crackings are scarcely present and which are excellent in surface smoothness. The mixture is successively served to step S4 for removing the less water-soluble alkaline earth metal salt.

Removing step S4 for the less water-soluble alkaline earth metal salt is a step of removing the less water-soluble alkaline earth metal salt deposited on the surface of the synthetic resin particles obtained at preparation step S3 for the synthetic resin particles. The less water-soluble alkaline earth metal salt is removed, for example, by the addition of the ionic material to the mixture containing the synthetic resin particles.

The ionic material identical with that used at preparation step S3 for the synthetic resin particles can be used in the same form (preferably in the form of aqueous solution) Among them, acids are preferred and inorganic acids, for example, hydrochloric acid, sulfuric acid and nitric acid are further preferred. In a case of using the inorganic acid, the less water-soluble alkaline earth metal salt is removed, for example, by controlling the pH of the mixture containing the synthetic resin particles to an acidic range, for example, from 1.0 to 3.0 and, optionally, leaving them for an appropriate time. The leaving time after the pH control can be properly decided, for example, in accordance with the kind and the residual amount of the less water-soluble alkaline earth metal salt, the kind and the amount of use of the ionic acid.

Separation-cleaning-drying step S5 is a step of separating the synthetic resin particles from the mixture containing the synthetic resin particles after decomposition and removal of the less water-soluble alkaline earth metal salt at previous step S4, drying them and, further, optionally classifying them to obtain toner particles of the invention.

Separation and recovery of the synthetic resin particles from the mixture can be practiced in accordance with known methods which include, for example, filtration, filtration under suction and centrifugal separation.

At step S5, the synthetic resin particles may be washed with water before separation of the synthetic resin particles. Alternatively, water cleaning may be conducted after separation of the synthetic resin particles. Water cleaning for the synthetic resin particles is conducted in order to remove impurities derived from the less water-soluble alkaline earth metal salt, the ionic material, etc. In a case where such impurities are deposited on the toner particles, the charging performance of the obtained toner particles may possibly be degraded due to the effect of the water content in air. The water cleaning for the synthetic resin particles is preferably conducted repetitively till the conductivity of cleaning water after cleaning the synthetic resin particles (supernatants) lowers to 50 μS/cm or lower by using a conductivity meter or the like. This can make the charging amount of the toner particles further uniform. The water used for water cleaning is preferably water at a conductivity of 20 μS/cm or lower. Such water can be obtained, for example, by an activated carbon method, an ion exchanging method, a distillation method or a reverse osmosis method. Naturally, two or more types of the methods may be combined for the preparation of water. Water cleaning for the synthetic resin particles may be practiced batchwise or continuously. While the temperature of the cleaning water is not particularly restricted, it is preferably within a range from 10 to 80° C.

Drying can be conducted in accordance with a known method. In a case of drying the toner particles, it is preferred to conduct drying after checking the presence or absence of impurities by a conductivity meter or the like. Specific methods of drying include, for example, a freeze-drying method and a gas stream type drying method.

Classification can be conducted in the same manner as in the existent wet process. Further, a wet classification method such as a wet cyclone method can also be used in combination. By the classification, toner particles having a desired grain size distribution can be obtained. The classification may also be conducted before drying.

Thus, in the method of manufacturing a toner of the invention, step s6 is reached and, toner particles are obtained. The toner particles can be used as they are as a toner for the development of static charges. Further, additives such as silica or titanium oxide can be added to the toner particles. The additives can be applied with various surface modifications, for example, with a silane coupling agent (hydrophobic treatment). While the ratio of using the toner particles and the additives is not particularly restricted, the additives are usually used, preferably, from 0.1 to 10 parts by weight, more preferably, from 1 to 5 parts by weight based on 100 parts by weight of the toner particles. As described above, the sequence of the steps ends.

The toner obtained according to the manufacturing method of the invention can be used as a one-component developer and a two-component developer. In a case of using the one-component developer, particularly, as a non-magnetic toner, the toner can be supplied to electrostatic latent images (static images) on the surface of the light sensitive body by transportation while depositing the toner on a developing sleeve by frictionally charging the same using a blade and a fur brush.

Further, in a case of use as the two-component developer, a carrier is used together with the toner of the invention and used as a developer. The carrier used together with the toner according to the invention is not particularly restricted and those customarily used in this field can be used. Composite ferrite comprising, for example, iron, copper, zinc, nickel, cobalt, manganese and chromium elements and/or ferrite, carrier core particles coated at the surface with coating material are mainly used. The coating material can be properly selected depending on the ingredients contained in the toner and include, for example, polytetrafluoroethylene, monochlorotrifluoroethylene polymer, polyvinylidene fluoride, silicone resin, polyester resin, metal compounds of ditertiary butyl salicylate, styrenic resin, acrylic resin, polyacid, polyvinylal, nigrosine, aminoacrylate resin, basic dyes and lake products thereof, fine silica powder and fine alumina powder. The coating materials can be used each alone or two or more of the materials can be used together. The average grain size of the carrier is from 10 to 100 μm and, preferably, from 20 to 50 μm.

EXAMPLE

The invention is to be described specifically with reference to examples and comparative examples but the invention is no way restricted to them.

[Preparation of Water]

In the following examples and comparative examples, water at a conductivity of 0.5 μS/cm for preparing an aqueous solution of a less water-soluble alkaline earth metal salt, for cleaning toner particles and for preparing an aqueous solution of an ionic material. The cleaning water was prepared from city water by using a super pure water preparation apparatus (Ultra Pure Water System CPW-102, trade name of products manufactured by ADVANTEC Co.). The conductivity of water was measured by using a Lacom Tester EC-PHCON 10 (trade name of products manufactured by Iuchi Seieido).

[Grain Size and Grain Size Distribution]

The grain size (volume average grain size, number average grain size) and the grain size distribution of synthetic resin particles and toner particles were measured by using a Coulter Multisizer-11 (trade name of products manufactured by Coulter Co.). The number of particles measured was 50,000 counts and the aperture diameter was 100 μm.

[Average Circularity]

The average circularity of toner particles was measured by using a flow type particle image analyzer (FPIA-2000, trade name of products manufactured by Toa Iyo Denshi Co.). The average circularity is defined in particle images detected by this measuring apparatus as: (peripheral length of a circle having an identical projection area with that of the particle image)/(peripheral length of the particle projection image) and takes a value of 1 or less. As the value approaches 1, it means that the shape of the toner particles is nearer to a true sphere.

[Preparation of Aqueous Solution of Ionic Material]

The aqueous solution of the ionic material was prepared by dissolving the ionic material in water at a conductivity of 0.5 μS/cm. Water in which the ionic material was dissolved was added, after stirring and after stopping the heating, while pressurizing it to a pressure higher than that in a stirring vessel by way of a valve attached to the vessel. As the ionic material, hydrochloric acid and an acetic acid were used.

Example 1

After mixing and dispersing 100 parts of a polyester resin (Tg: 62° C., softening point: 110° C.), 5 parts by weight of colorant (carbon black), 2 parts by weight of wax (polypropylene) and 1 part by weight of charge controller (BONTRON E-84, trade name of products manufactured by Orient Chemical Co.) in a Henschel mixer for 30 min, they were dispersed under melt-kneading by using an extruder (KNEADEX MOS 140-800, trade name of products manufactured by Mitsui Mining Co.), to prepare a resin kneaded product in a molten state.

On the other hand, 20 parts by weight of calcium carbonate with a primary grain size of 0.1 μm and 80 parts by weight of water were charged in a dispersing machine (FILMIX Model 56, trade name of products manufactured by Tokushukikakogyo Co.), and dispersed at 40 m/sec for 60 min to prepare an aqueous solution 20% by weight of calcium carbonate. When the average dispersion diameter of calcium carbonate after dispersion was measured by a laser diffraction/scattering type grain size distribution measuring apparatus (LA-920, trade name of products manufactured by Horiba Seisakusho) as 50% frequency grain size (medial diameter) on the volume base, it was 0.70 μm. In the following examples and comparative examples, the content of calcium carbonate was controlled by properly adding water to the aqueous dispersion for use.

20 parts by weight of a resin kneaded product in a molten state and 500 parts by weight of an aqueous solution of calcium carbonate (2 parts by weight of solid content) were charged in a metal vessel having a pressure control valve, a heating means and a rotor stator type stirring means (30 mm of opening diameter) and stirred while heating and pressurizing at 150° C. and 5 atom for 10 min (8000 rpm). Then, heating was stopped and 200 mL of an aqueous solution of hydrochloric acid controlled to the concentration in Table 1 (concentration: 4 mmol, ratio to the amount of hydrochloric acid decomposing the entire amount of calcium carbonate: 10% by weight) was added as an ionic material. Hydrochloric acid was added after stopping the heating and while pressurizing to a pressure higher than that in the vessel by way of a valve attached to a stirring vessel for 5 min. When cooling spontaneously down to 20° C., a slurry containing synthetic resin particles as the starting toner material was obtained.

Figure 2:
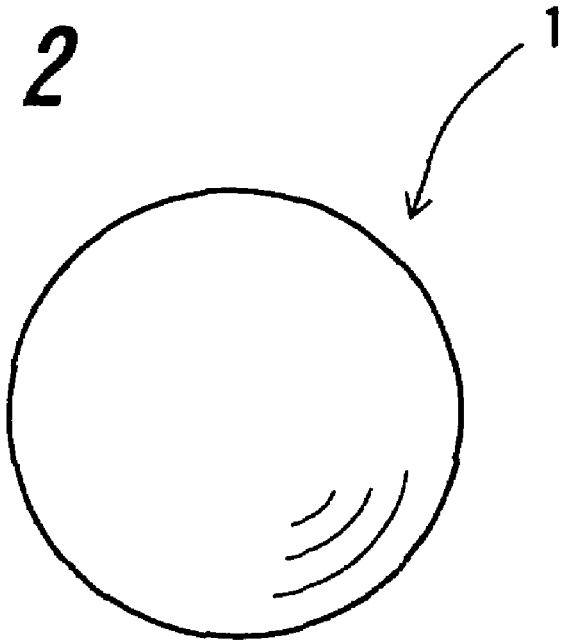
FIG. 2 is a perspective view schematically showing the appearance of a synthetic resin particle obtained in Example 1.

After adding an aqueous solution of hydrochloric acid (4 mmol concentration) further to 720 parts by weight of the slurry containing the synthetic resin, and completely decomposing and removing calcium carbonate on the surface of the synthetic resin particles by adjusting pH of the slurry to 1, cleaning was conducted by adding water at a conductivity of 0.5 μS/cm. In the cleaning, the slurry and water (conductivity; 0.5 μS/cm) were mixed and after controlling the solid content to 10% by weight depending on the addition amount of water, they were stirred by a turbine type stirring blade for 30 min (300 rpm), and the same cleaning procedures were repeated till the conductivity of supernatants separated by centrifugal separation from the mixture was reduced to 10 μS/cm or lower. Then, the synthetic resin particles in the slurry were fractionated by centrifugal separation, and dried to obtain 20 parts by weight of synthetic resin particles. Particles grown by adherance of particles to each other were not contained in the obtained synthetic resin particles. The synthetic resin particles had a volume average grain size of 7.8 μm and a number average particle size of 6.3 μm. A portion of them was fractionated and dried and when observed under a scanning electron microscope (SEM), concaved portions, apertures, crackings, etc. were not observed on the surface of the particles and a spherical synthetic resin particle 1 with smooth surface was observed as shown in FIG. 2. FIG. 2 is a perspective view schematically showing the appearance of the synthetic resin particle obtained in Example 1.

The synthetic resin particles obtained as described above were dispersed in water, classified in water by a precipitation method and, after removing fine powder, freeze dried to obtain toner particles with a volume average grain size of 8.8 μm and a circularity of 0.98. 0.7 parts by weight of silica particles applied with a hydrophobic treatment by a silane coupling agent with an average primary grain size of 20 nm was mixed to 100 parts by weight of the toner particles to obtain a toner of the invention.

Example 2

Synthetic resin particles as a starting toner material with a volume average grain size of 7.8 μm and a number average grain size of 6.3 μm were obtained by the same procedures as those in Example 1 except for adding 200 mL of an aqueous solution of hydrochloric acid as an ionic material (concentration: 12 mmol, ratio to the amount of hydrochloric acid decomposing the entire amount of calcium carbonate of 30% by weight). A portion of them was fractionated and dried and, when observed under a scanning electron microscope (SEM), concaved portions, apertures, crackings, etc. were not observed on the particle surface and spherical synthetic resin particles with smooth surface like in Example 1 were observed. Further, classification and drying were conducted in the same manner as in Example 1 to manufacture toner particles with a volume average grain size of 8.8 μm and a circularity of 0.98. Successively, 0.7 parts by weight of silica particles applied with a hydrophobic treatment by a silane coupling agent with an average primary grain size of 20 nm was mixed to 100 parts by weight of the toner particles, to manufacture a toner of the invention.

Example 3

Synthetic resin particles as a starting toner material with a volume average grain size of 7.6 μm and a number average grain size of 6.2 μm were obtained by the same procedures as those in Example 1 except for adding 200 mL of an aqueous solution of hydrochloric acid as an ionic material (concentration: 20 mmol, ratio to the amount of hydrochloric acid decomposing the entire amount of calcium carbonate of 50% by weight). A portion of them was fractionated and dried and, when observed under a scanning electron microscope (SEM), concaved portions, apertures, crackings, etc. were not observed on the particle surface and spherical synthetic resin particles with smooth surface like in Example 1 were observed. Further, classification and drying were conducted in the same manner as in Example 1 to manufacture toner particles with a volume average grain size of 8.9 μm and a circularity of 0.98. Successively, 0.7 parts by weight of silica particles applied with a hydrophobic treatment by a silane coupling agent with an average primary grain size of 20 nm was mixed to 100 parts by weight of the toner particles, to manufacture a toner of the invention.

Example 4

Synthetic resin particles as a starting toner material with a volume average grain size of 6.3 μm and a number average grain size of 5.3 μm were obtained by the same procedures as those in Example 1 except for using 500 parts by weight (solid content of 20 parts by weight) of an aqueous dispersion of calcium carbonate and adding 200 mL of an aqueous solution of hydrochloric acid as an ionic material (concentration: 40 mmol, ratio to the amount of hydrochloric acid decomposing the entire amount of calcium carbonate of 10% by weight). A portion of them was fractionated and dried and, when observed under a scanning electron microscope (SEM), concaved portions, apertures, crackings, etc. were not observed on the particle surface and spherical synthetic resin particles with smooth surface like in Example 1 were observed. Further, classification and drying were conducted in the same manner as in Example 1 to manufacture toner particles with a volume average grain size of 7.1 μm and a circularity of 0.98. Successively, 0.7 parts of silica particles applied with a hydrophobic treatment by a silane coupling agent with an average primary grain size of 20 nm was mixed to 100 parts by weight of the toner particles, to manufacture a toner of the invention.

Example 5

Synthetic resin particles as a starting toner material with a volume average grain size of 6.3 μm and a number average grain size of 5.3 μm were obtained by the same procedures as those in Example 4 except for adding 200 mL of an aqueous solution of hydrochloric acid as an ionic material (concentration: 120 mmol, ratio to the amount of hydrochloric acid decomposing the entire amount of calcium carbonate of 30% by weight). A portion of them was fractionated and dried and, when observed under a scanning electron microscope (SEM), concaved portions, apertures, crackings, etc. were not observed on the particle surface and spherical synthetic resin particles with smooth surface like in Example 1 were observed. Further, classification and drying were conducted in the same manner as in Example 1 to manufacture toner particles with a volume average grain size of 7.1 μm and a circularity of 0.98. Successively, 0.7 parts by weight of silica particles applied with a hydrophobic treatment by a silane coupling agent with an average primary grain size of 20 nm was mixed to 100 parts by weight of the toner particles, to manufacture a toner of the invention.

Example 6

Synthetic resin particles as a starting toner material with a volume average grain size of 6.4 μm and a number average grain size of 5.3 μm were obtained by the same procedures as those in Example 4 except for adding 200 mL of a diluted hydrochloric acid as an ionic material (200 mmol, ratio to the amount of hydrochloric acid decomposing the entire amount of calcium carbonate of 50% by weight). A portion of them was fractionated and dried and, when observed under a scanning electron microscope (SEM), concaved portions, apertures, crackings, etc. were not observed on the particle surface and spherical synthetic resin particles with smooth surface like in Example 1 were observed. Further, classification and drying were conducted in the same manner as in Example 1 to manufacture toner particles with a volume average grain size of 7.2 μm and a circularity of 0.98. Successively, 0.7 parts by weight of silica particles applied with a hydrophobic treatment by a silane coupling agent with an average primary grain size of 20 nm was mixed to 100 parts by weight of the toner particles, to manufacture a toner of the invention.

Example 7

Synthetic resin particles as a starting toner material with a volume average grain size of 5.6 μm and a number average grain size of 4.4 μm were obtained by the same procedures as those in Example 1 except for using 500 parts by weight (solid content of 100 parts by weight) of an aqueous dispersion of calcium carbonate and adding 200 mL of an aqueous solution of hydrochloric acid as an ionic material (concentration: 200 mmol, ratio to the amount of hydrochloric acid decomposing the entire amount of calcium carbonate of 10% by weight). A portion of them was fractionated and dried and, when observed under a scanning electron microscope (SEM), concaved portions, apertures, crackings, etc. were not observed on the particle surface and spherical synthetic resin particles with smooth surface like in Example 1 were observed. Further, classification and drying were conducted in the same manner as in Example 1 to manufacture toner particles with a volume average grain size of 5.8 μm and a circularity of 0.98. Successively, 0.7 parts by weight of silica particles applied with a hydrophobic treatment by a silane coupling agent with an average primary grain size of 20 nm was mixed to 100 parts by weight of the toner particles, to manufacture a toner of the invention.

Example 8

Synthetic resin particles as a starting toner material with a volume average grain size of 5.5 μm and a number average grain size of 4.3 μm were obtained by the same procedures as those in Example 7 except for adding 200 mL of an aqueous solution of hydrochloric acid as an ionic material (concentration: 600 mmol, ratio to the amount of hydrochloric acid decomposing the entire amount of calcium carbonate of 30% by weight). A portion of them was fractionated and dried and, when observed under a scanning electron microscope (SEM), concaved portions, apertures, crackings, etc. were not observed on the particle surface and spherical synthetic resin particles with smooth surface like in Example 1 were observed. Further, classification and drying were conducted in the same manner as in Example 1 to manufacture toner particles with a volume average grain size of 5.7 μm and a circularity of 0.98. Successively, 0.7 parts by weight of silica particles applied with a hydrophobic treatment by a silane coupling agent with an average primary grain size of 20 nm was mixed to 100 parts by weight of the toner particles, to manufacture a toner of the invention.

Example 9

Synthetic resin particles as a starting toner material with a volume average grain size of 5.5 μm and a number average grain size of 4.3 μm were obtained by the same procedures as those in Example 7 except for adding 200 mL of an aqueous solution of hydrochloric acid as an ionic material (concentration: 1000 mmol, ratio to the amount of hydrochloric acid decomposing the entire amount of calcium carbonate of 50% by weight). A portion of them was fractionated and dried and, when observed under a scanning electron microscope (SEM), concaved portions, apertures, crackings, etc. were not observed on the particle surface and spherical synthetic resin particles with smooth surface like in Example 1 were observed. Further, classification and drying were conducted in the same manner as in Example 1 to manufacture toner particles with a volume average grain size of 5.7 μm and a circularity of 0.98. Successively, 0.7 parts by weight of silica particles applied with a hydrophobic treatment by a silane coupling agent with an average primary grain size of 20 nm was mixed to 100 parts by weight of the toner particles, to manufacture a toner of the invention.

Example 10

Synthetic resin particles as a starting toner material with a volume average grain size of 6.3 μm and a number average grain size of 5.3 μm were obtained by the same procedures as those in Example 1 except for using 500 parts by weight (solid content of 20 parts by weight) of an aqueous dispersion of calcium tertiary phosphate and adding 200 mL of an aqueous solution of hydrochloric acid as an ionic material (concentration: 116 mmol, ratio to the amount of hydrochloric acid decomposing the entire amount of calcium carbonate of 30% by weight). A portion of them was fractionated and dried and, when observed under a scanning electron microscope (SEM), concaved portions, apertures, crackings, etc. were not observed on the particle surface and spherical synthetic resin particles with smooth surface like in Example 1 were observed. Further, classification and drying were conducted in the same manner as in Example 1 to manufacture toner particles with a volume average grain size of 7.0 μm and a circularity of 0.98. Successively, 0.7 parts by weight of silica particles applied with a hydrophobic treatment by a silane coupling agent with an average primary grain size of 20 nm was mixed to 100 parts by weight of the toner particles, to manufacture a toner of the invention.

Example 11

Synthetic resin particles as a starting toner material with a volume average grain size of 6.3 μm and a number average grain size of 5.3 μm were obtained by the same procedures as those in Example 4 except for adding 200 mL of an aqueous solution of acetic acid as an ionic material (concentration: 120 mmol, ratio to the amount of acetic acid decomposing the entire amount of calcium carbonate of 30% by weight). A portion of them was fractionated and dried and, when observed under a scanning electron microscope (SEM), concaved portions, apertures, crackings, etc. were not observed on the particle surface and spherical synthetic resin particles with smooth surface like in Example 1 were observed. Further, classification and drying were conducted in the same manner as in Example 1 to manufacture toner particles with a volume average grain size of 7.1 μm and a circularity of 0.98. Successively, 0.7 parts by weight of silica particles applied with a hydrophobic treatment by a silane coupling agent with an average primary grain size of 20 nm was mixed to 100 parts by weight of the toner particles, to manufacture a toner of the invention.

Comparative Example 1

Figure 3:
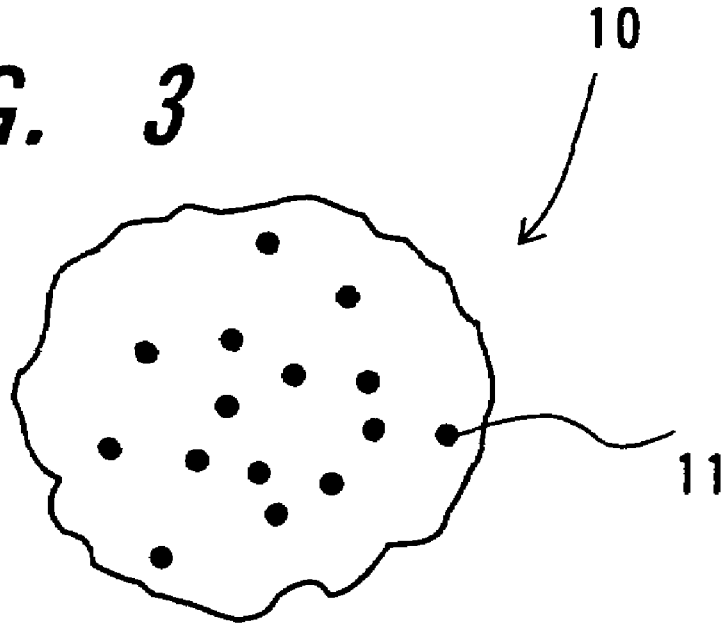
FIG. 3 is a front elevational view schematically showing the appearance of a synthetic resin particle obtained in Comparative Example 1.

Synthetic resin particles as a starting toner material with a volume average grain size of 7.8 μm and a number average grain size of 6.3 μm were obtained by the same procedures as those in Example 1 except for adding 200 mL of an aqueous solution of hydrochloric acid as an ionic material (concentration: 2 mmol, ratio to the amount of hydrochloric acid decomposing the entire amount of calcium carbonate of 5% by weight). Further, after completely decomposing to remove calcium carbonate on the surface of the synthetic resin particles in the same manner as in Example 1, cleaning was conducted and, when a portion of them was fractionated and dried and observed under a scanning electron microscope (SEM), indented and apertured synthetic resin particles 10 having partially concaved portions 11 at the surface were observed as shown in FIG. 3 and cracked synthetic resin particles were also present. FIG. 3 is a front elevational view schematically showing the appearance of the synthetic resin particles obtained in Comparative Example 1.

Comparative Example 2

Synthetic resin particles as a starting toner material were obtained by the same procedures as those in Example 1 except for adding 200 mL of an aqueous solution of hydrochloric acid as an ionic material (concentration: 22 mmol, ratio to the entire amount of calcium carbonate of 55% by weight). Further, after completely decomposing to remove calcium carbonate on the surface of the synthetic resin particles in the same manner as in Example 1, cleaning was conducted and, when a portion of them was fractionated and dried and observed under a scanning electron microscope (SEM), synthetic resin particles in which particles were fused and agglomerated to each other were observed.

Comparative Example 3

Synthetic resin particles as a starting toner material with a volume average grain size of 6.3 μm and a number average grain size of 5.3 μm were obtained by the same procedures as those in Example 1 except for using 500 parts by weight (solid content of 20 parts by weight) of an aqueous dispersion of calcium carbonate and adding 200 mL of an aqueous solution of hydrochloric acid as an ionic material (concentration: 20 mmol, ratio to the amount of hydrochloric acid decomposing the entire amount of calcium carbonate of 5% by weight). Further, after completely decomposing to remove calcium carbonate on the surface of the synthetic resin particles in the same manner as in Example 1, cleaning was conducted and, when a portion of them was fractionated and dried and observed under a scanning electron microscope (SEM), synthetic resin particles partially concaved and apertured at the surface were observed like in Comparative Example 1 and cracked synthetic resin particles were also present.

Comparative Example 4

Synthetic resin particles as a starting toner material were obtained by the same procedures as those in Comparative Example 3 except for adding 200 mL of an aqueous solution of hydrochloric acid as an ionic material (concentration: 220 mmol, ratio to the amount of hydrochloric acid decomposing the entire amount of calcium carbonate of 55% by weight). Further, after completely decomposing to remove calcium carbonate on the surface of the synthetic resin particles in the same manner as in Example 1, cleaning was conducted and, when a portion of them was fractionated and dried and observed under a scanning electron microscope (SEM) synthetic resin particles, in which particles were fused and agglomerated to each other were observed.

Comparative Example 5

Synthetic resin particles as a starting toner material with a volume average grain size of 5.6 μm and a number average grain size of 4.4 μm were obtained by the same procedures as those in Example 1 except for using 500 parts by weight (solid content of 100 parts by weight) of an aqueous dispersion of calcium carbonate and adding 200 mL of an aqueous solution of hydrochloric acid as an ionic material (concentration: 100 mmol, ratio to the amount of hydrochloric acid decomposing the entire amount of calcium carbonate of 5% by weight). Further, after completely decomposing to remove calcium carbonate on the surface of the synthetic resin particles in the same manner as in Example 1, cleaning was conducted and, when a portion of them was fractionated and dried and observed under a scanning electron microscope (SEM), synthetic resin particles partially concaved and apertured at the surface were observed like in Comparative Example 1, and cracked synthetic resin particles were also present.

Comparative Example 6

Synthetic resin particles as a starting toner material were obtained by the same procedures as those in Comparative Example 5 except for adding 200 mL of an aqueous solution of diluted hydrochloric acid as an ionic material (concentration: 1200 mmol, ratio to the amount of hydrochloric acid decomposing the entire amount of calcium carbonate of 55% by weight). Further, after completely decomposing to remove calcium carbonate on the surface of the synthetic resin particles in the same manner as in Example 1, cleaning was conducted and, when a portion of them was fractionated and dried and observed under a scanning electron microscope (SEM), synthetic resin particles in which particles were fused and agglomerated to each other were observed.

Comparative Example 7

Synthetic resin particles as a starting toner material were obtained by the same procedures as those in Example 1 except for not adding the ionic material (an aqueous solution of hydrochloric acid). Further, after completely decomposing to remove calcium carbonate on the surface of the synthetic resin particles in the same manner as in Example 1, cleaning was conducted and, when a portion of them was fractionated and dried and observed under a scanning electron microscope (SEM), synthetic resin particles partially concaved and apertured at the surface were observed like in Comparative Example 1, and cracked synthetic resin particles were also present.

Comparative Example 8

Synthetic resin particles as a starting toner material were obtained by the same procedures as those in Example 1 except for using 500 parts by weight (solid content of 100 parts by weight) of an aqueous dispersion of calcium carbonate and not adding the ionic material (an aqueous solution of hydrochloric acid). Further, after completely decomposing to remove calcium carbonate on the surface of the synthetic resin particles in the same manner as in Example 1, cleaning was conducted and, when a portion of them was fractionated and dried and observed under a scanning electron microscope (SEM), synthetic resin particles partially concaved and apertured at the surface were observed like in Comparative Example 1, and cracked synthetic resin particles were also present.

Test Example 1

The toners (developer) obtained in Examples 1 to 11 and a ferrite core carrier with an average grain size of 60 μm were controlled and mixed such that the toner concentration was 5% by weight to prepare 2-component developers.

Using the developer, printing was conducted on "exclusive full color paper" (product No: PP106A4C, A4 size, manufactured by Sharp Corp.) by using a laser printer (AR-C150, trade name of products manufactured by Sharp Corp.), with the deposition amount of the toner being controlled to 0.6 mg/cm$^2$, and image samples were prepared by using an external fixing machine.

Respective image samples were prepared and served for the following evaluation. Table 1 shows the results.

(Surface State)

Evaluation was made for those with no indents and apertures on the surface as "no", those with indents and apertures as "yes", and those with agglomeration of particles as "agglomeration".

(Optical Density)

They were measured by a spectral colorimetric densitometer (X-Rite 938, trade name of products manufactured by Nippon Heiban Insatsukizai Co.) and it was judged good in a case where the optical density was 1.4 or more.

(White Background Fog)

In a case of a black toner, the whiteness of exclusive full color paper (PP106A4C) was previously measured by a whiteness meter (manufactured by Nippon Denshoku Industry Co.) and the value was defined as a first measuring value. Then, three sheets of originals each containing a white circle of 55 mm diameter were copied, the white portion of the obtained copy products was measured by the whiteness meter, and the value was defined as a second measuring value. The value obtained by subtracting the second measuring value from the first measuring value was defined as a fogging density (%) and, in a case where the value was 2.0% or less, it was judged good (o).

(Transfer Ratio)

It was calculated based on the weight Mp of the toner on a paper surface of the sample copied in a predetermined chart and the weight Md of the toner remained on the light sensitive body and, in a case where the value was 85% or more, it was judged satisfactory. The transfer ratio (%) is determined according to the following equation.

Transfer ratio (%)=[Mp /(Md+Mp )]×100

(Overall Evaluation)

Evaluation was made in accordance with the following standards.

O: With no apertures or crackings on the surface of the particles, the optical density of 1.4 or more, the fogging density of 2.0 or less, and the transfer ratio of 85% or more.

x: those not satisfying the conditions describe above.

TABLE 1

| | | Resin kneaded product | Alkaline earth metal salt B | | Weight ratio | Ionic Material | | Decomposition |
|---|---|---|---|---|---|---|---|---|
| | | Ag | Species | g (mmol) | B/A % | Species | mmol | rate for B % |
| Example | 1 | 20 | Calcium carbonate | 2 (20) | 10 | HCl | 4 | 10 |
| | 2 | 20 | Calcium carbonate | 2 (20) | 10 | HCl | 12 | 30 |
| | 3 | 20 | Calcium carbonate | 2 (20) | 10 | HCl | 20 | 50 |
| | 4 | 20 | Calcium carbonate | 20 (200) | 100 | HCl | 40 | 10 |
| | 5 | 20 | Calcium carbonate | 20 (200) | 100 | HCl | 120 | 30 |
| | 6 | 20 | Calcium carbonate | 20 (200) | 100 | HCl | 200 | 50 |
| | 7 | 20 | Calcium carbonate | 100 (1000) | 500 | HCl | 200 | 10 |
| | 8 | 20 | Calcium carbonate | 100 (1000) | 500 | HCl | 600 | 30 |
| | 9 | 20 | Calcium carbonate | 100 (1000) | 500 | HCl | 1000 | 50 |
| | 10 | 20 | Calcium tertiary phosphate | 20 (65) | 100 | HCl | 116 | 30 |
| | 11 | 20 | Calcium carbonate | 20 (200) | 100 | $CH_3COOH$ | 120 | 30 |
| Comp. Example | 1 | 20 | Calcium carbonate | 2 (20) | 10 | HCl | 2 | 5 |
| | 2 | 20 | Calcium carbonate | 2 (20) | 10 | HCl | 22 | 55 |
| | 3 | 20 | Calcium carbonate | 20 (200) | 100 | HCl | 20 | 5 |
| | 4 | 20 | Calcium carbonate | 20 (200) | 100 | HCl | 220 | 55 |
| | 5 | 20 | Calcium carbonate | 100 (1000) | 500 | HCl | 100 | 5 |
| | 6 | 20 | Calcium carbonate | 100 (1000) | 500 | HCl | 1100 | 55 |
| | 7 | 20 | Calcium carbonate | 2 (20) | 10 | — | 0 | 0 |
| | 8 | 20 | Calcium carbonate | 100 (1000) | 500 | — | 0 | 0 |

| | | Volume average grain size μm | Average circularity | Surface state | Optical density | White back-ground | Transfer ratio % | Overall evaluation |
|---|---|---|---|---|---|---|---|---|
| Example | 1 | 8.8 | 0.98 | No | 1.5 | ○ | 86 | ○ |
| | 2 | 8.8 | 0.98 | No | 1.5 | ○ | 86 | ○ |
| | 3 | 8.9 | 0.98 | No | 1.5 | ○ | 86 | ○ |
| | 4 | 7.1 | 0.98 | No | 1.5 | ○ | 89 | ○ |

TABLE 1-continued

| | | | | | | | | |
|---|---|---|---|---|---|---|---|---|
| | 5 | 7.1 | 0.98 | No | 1.5 | ○ | 89 | ○ |
| | 6 | 7.2 | 0.98 | No | 1.5 | ○ | 89 | ○ |
| | 7 | 5.8 | 0.98 | No | 1.5 | ○ | 90 | ○ |
| | 8 | 5.7 | 0.98 | No | 1.5 | ○ | 90 | ○ |
| | 9 | 5.7 | 0.98 | No | 1.5 | ○ | 90 | ○ |
| | 10 | 7.0 | 0.98 | No | 1.5 | ○ | 88 | ○ |
| | 11 | 7.1 | 0.98 | No | 1.5 | ○ | 89 | ○ |
| Comp. Example | 1 | — | — | Yes | — | — | — | X |
| | 2 | — | — | Agglomeration | — | — | — | X |
| | 3 | — | — | Yes | — | — | — | X |
| | 4 | — | — | Agglomeration | — | — | — | X |
| | 5 | — | — | Yes | — | — | — | X |
| | 6 | — | — | Agglomeration | — | — | — | X |
| | 7 | — | — | Yes | — | — | — | X |
| | 8 | — | — | Yes | — | — | — | X |

From Table 1, it is apparent that the toner particles obtained by the manufacturing method according to the invention have preferred grain size and shape as the toner particles, are excellent in the transferability to the transfer paper and can form images at high image density with no white background fogging on the transfer paper. In the examples, while hydrochloric acid as the inorganic acid and acetic acid as the organic acid are used as the ionic material, hydrochloric acid is more preferred in view of the cleaning of the resin particles since the byproducts obtained by reaction with the alkaline earth metal salt is easily water-soluble.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A method of manufacturing a toner comprising:

a step (A) of forming synthetic resin particles containing a colorant, whose surfaces are covered with a less water-soluble alkaline earth metal salt by mixing a resin kneaded product at least containing the synthetic resin and the colorant and not containing an organic solvent and an aqueous dispersion of the less water-soluble alkaline earth metal salt under heating or under heating and pressurization and cooling them; and a step (B) of removing the less water-soluble alkaline earth metal salt from the surface of the synthetic resin particles containing the colorant, wherein an ionic material that decomposes the less water-soluble alkaline earth metal salt is added to the mixture of the resin kneaded product and the aqueous dispersion of the less water-soluble alkaline earth metal salt in the step (A)

wherein the addition amount of the ionic material in the step (A) is from 10% by weight to 50% by weight based on an amount of the ionic material that completely decomposes the less water-soluble alkaline earth metal salt.

2. The method of claim 1, wherein addition of the ionic material in the step (A) is conducted at the same time with the mixing of the resin kneaded product and the aqueous dispersion of the less water-soluble alkaline earth metal salt, or after mixing of them and before the cooling of the mixture.

3. The method of claim 2, wherein the ionic material is an inorganic acid and/or an organic acid.

4. The method of claim 3, wherein the ionic material is used in the form of an aqueous solution.

5. The method of claim 2, wherein the ionic material is used in the form of an aqueous solution.

6. The method of claim 1, wherein removal of the less water-soluble alkaline earth metal salt in the step (B) is conducted by the addition of the ionic material that decomposes the less water-soluble alkaline earth metal salt.

7. The method of claim 6, wherein the ionic material is an inorganic acid and/or an organic acid.

8. The method of claim 7, wherein the ionic material is used in the form of an aqueous solution.

9. The method of claim 6, wherein the ionic material is used in the form of an aqueous solution.

10. The method of claim 1, wherein the ionic material is an inorganic acid and/or an organic acid.

11. The method of claim 10, wherein the ionic material is used in the form of an aqueous solution.

12. The method of claim 1, wherein the ionic material is used in the form of an aqueous solution.

13. The method of claim 1, wherein the less water-soluble alkaline earth metal salt is a calcium carbonate salt.

* * * * *